US011850616B2

(12) United States Patent
Scheerer et al.

(10) Patent No.: US 11,850,616 B2
(45) Date of Patent: Dec. 26, 2023

(54) COATING DEVICE WITH FLUID-CONDUCTING ROTARY FEED THROUGH FOR COMPRESSED AIR TO SPRAY HEADS

(71) Applicant: Robert Bürkle GmbH, Freudenstadt (DE)

(72) Inventors: Marcel Scheerer, Freudenstadt (DE); Michael Hoffer, Lossburg (DE)

(73) Assignee: Robert Bürkle GmbH, Freudenstadt (DE)

( * ) Notice: Subject to any disclaimer, the term of this patent is extended or adjusted under 35 U.S.C. 154(b) by 0 days.

(21) Appl. No.: 17/889,519

(22) Filed: Aug. 17, 2022

(65) Prior Publication Data

US 2023/0058008 A1 Feb. 23, 2023

(30) Foreign Application Priority Data

Aug. 19, 2021 (DE) ..... 102021121591.9

(51) Int. Cl.

| | |
|---|---|
| ***B05B 13/04*** | (2006.01) |
| ***B05B 7/08*** | (2006.01) |
| ***B05B 9/04*** | (2006.01) |
| ***B05B 12/08*** | (2006.01) |
| ***B05B 12/10*** | (2006.01) |
| ***B05B 15/652*** | (2018.01) |

(52) U.S. Cl.

CPC ..... *B05B 13/0421* (2013.01); *B05B 9/0406* (2013.01); *B05B 9/0423* (2013.01); *B05B 12/087* (2013.01); *B05B 12/10* (2013.01); *B05B 13/0447* (2013.01); *B05B 13/0484* (2013.01); *B05B 15/652* (2018.02); *B05B 7/0815* (2013.01)

(58) Field of Classification Search

None

See application file for complete search history.

(56) References Cited

U.S. PATENT DOCUMENTS 2,888,903 A * 6/1959 Faber ..... B05B 13/0421 118/316
3,034,475 A * 5/1962 Bowman ..... B05B 13/0421 118/680

(Continued)

FOREIGN PATENT DOCUMENTS

EP 2123363 A1 11/2009
JP 2003251234 A 9/2003

*Primary Examiner* — Binu Thomas
(74) *Attorney, Agent, or Firm* — Volpe Koenig

(57) ABSTRACT

A coating device for applying a coating agent to the surface of a workpiece. The coating device includes a frame with a workpiece receptacle, a coating agent source and a rotary unit which is rotatable in relation to the frame. The rotary unit has a pump and a plurality of spray units, with the pump on the suction side being connected to the coating agent source by a fluid-conducting rotary joint connection. The rotary unit has a pneumatic valve device, and the spray units have in each case one compressed air controlled valve for controlling the delivery of coating agent. The inlet side of the valve is connected to the compressed air source by a fluid-conducting rotary feedthrough, which simplifies the overall construction of the coating device by providing a pneumatic connection between the compressed air source and the rotary unit that is independent of the rotation angle.

21 Claims, 2 Drawing Sheets

(56) References Cited

U.S. PATENT DOCUMENTS

| | | | | |
|---|---|---|---|---|
| 3,135,629 | A * | 6/1964 | McLean | B05C 7/08 118/DIG. 10 |
| 3,908,592 | A * | 9/1975 | Ordway | B05B 13/0484 118/313 |
| 4,151,808 | A * | 5/1979 | Beck | B05B 13/0484 118/684 |
| 4,170,192 | A * | 10/1979 | Maddock | B05B 13/0636 118/DIG. 10 |
| 4,421,275 | A * | 12/1983 | Gratton | B05B 13/0636 239/226 |
| 6,632,475 | B1 * | 10/2003 | Bleggi | B05B 13/0636 118/302 |
| 10,060,027 | B2 | 8/2018 | Parent et al. | |
| 2003/0052189 | A1 * | 3/2003 | Kronz | B05B 13/0636 239/227 |
| 2006/0060677 | A1 * | 3/2006 | Giraud | B05B 13/0484 239/549 |

* cited by examiner

COATING DEVICE WITH FLUID-CONDUCTING ROTARY FEED THROUGH FOR COMPRESSED AIR TO SPRAY HEADS

INCORPORATION BY REFERENCE

The following documents are incorporated herein by reference as if fully set forth: German Patent Application No. DE 10 2021 121 591.9, filed Aug. 19, 2021.

TECHNICAL FIELD

The invention relates to a coating device.

BACKGROUND

Such coating devices are known from the prior art and serve for applying a coating agent to the surface of a workpiece. The coating agent can be, for example, varnish, in particular clearcoat, or pigmented varnish, a staining agent or paint. The workpiece can be, for example, a derived timber product part, or a construction module of such parts, for producing furniture. For coating, the workpiece is disposed on a workpiece receptacle and, by a plurality of moving spray units, subsequently provided with the coating agent.

In order to achieve a high rate of productivity it has proven successful in the prior art to configure coating devices so as to have in each case one machine frame and one rotary unit that is rotatable in relation to the machine frame. The machine frame here comprises the workpiece receptacle already mentioned above, while the rotary unit comprises the plurality of spray units likewise already mentioned. In a relative rotation of the rotary unit relative to the machine frame, the spray units sweep across the workpiece and in the process distribute the coating agent onto the workpiece surface.

One challenge in terms of construction that has to be overcome in the known coating devices lies in providing coating agent from a stationary coating agent source for the moving rotary unit and the spray units disposed on the latter. Rotary joints which have in each case a stationary rotary joint part and a rotatable rotary joint part are usually used for this purpose.

The stationary rotary joint part is disposed on the machine frame, while the rotatable rotary joint part is disposed on the rotary unit. The rotary joint parts mentioned are connected to one another while configuring a coating agent duct. At the same time, the rotary joint parts are mutually rotatable, wherein the fluid-conducting coating agent duct is maintained independently of the relative rotation angle between the rotary joint parts. The stationary rotary joint part comprises an infeed-proximal connector for the coating agent duct, the coating agent source being connected to said infeed-proximal connector. The rotatable rotary joint part comprises a connector for providing the coating agent for the spray units on the rotary unit.

It is known from US 2006/0060677 A1 to dispose a pump on the rotary unit. By way of the rotary joint the pump on the suction-side here is connected to the coating agent source, and on the pressure-side to the spray units. In comparison to an arrangement in which the pump is not disposed on the rotary unit but on the machine frame, the arrangement according to US 2006/0060677 A1 permits an extension of the service life of the respective rotary joint used. This has to do with the fact that the coating agent is not guided through the rotary joint under high pressure. Instead, the coating agent is highly pressurized downstream of the rotary joint, and in this instance by the pump, and conveyed to the spray units. As a result, the seals of the rotary joint are preserved in particular. This leads to a prolonged tightness of the rotary joint.

By virtue of the steadily increasing diversity of variants of workpieces, in particular furniture parts, to be coated, it is desirable that the operating mode of the coating device can be easily changed when required. This includes, for example, an individually adaptable configuration of the coating agent delivery as a function of the individual dimensions or of the material used for the workpieces to be coated.

However, one advantage of known coating devices lies in that the latter are usually embodied as special designs which serve primarily for coating mutually similar workpieces. It is indeed possible for constructive parameters of the coating device, such as, for instance, the number of spray units and the trajectory and speed of travel of the latter to be adapted to changing operating conditions. However, the required complexity in terms of construction is excessive and precludes the ability to react to the high diversity of variants of the workpieces to be coated in an economically efficient manner.

A high complexity in terms of construction is required in particular when components that can be actively controlled, for example control elements for the coating agent delivery, are to be retrofitted. This is because an increasing number of such components usually necessitates a corresponding high number of control lines, the latter having to be routed with great complexity from the machine frame to the rotary unit. Should the components to be controlled require a power supply for the operation of said components, additional power lines have moreover to be routed with likewise great constructive complexity from the machine frame to the rotary unit. As a result, the coating device becomes technically complex and thus also expensive.

SUMMARY

The invention is based on the object of providing a coating device which is associated with a high degree of adaptability to changing operation conditions, a good control capability, and at the same time a simple construction.

The object is achieved by a coating device having one or more of the features described herein. Advantageous refinements are to be found below and in the claims. Various features disclosed herein may be inventions in their own right, optionally in combination with features described herein.

The coating device according to the invention comprises a machine frame having a workpiece receptacle, a coating agent source as well as a compressed air source. The coating device furthermore comprises a rotary unit which is rotatable in relation to the machine frame and has a pump and a plurality of spray units, the pump on the suction side being connected to the coating agent source by way of a fluid-conducting rotary joint, and on the pressure side being connected to the spray units.

According to the invention, the rotary unit has a pneumatic valve device. Furthermore, the spray units each have a compressed air controlled valve for controlling the delivery of coating agent. The valve device on the intake air side is connected to the compressed air source at least by way of a fluid-conducting rotary feedthrough, and on the exhaust air side connected to the compressed air controlled valves of the spray units.

The invention is based on the concept that the disposal of an additional component in the form of the pneumatic valve device on the rotary unit leads to an overall simple construction of the coating device and simultaneously improves the controllability of the latter.

The simple construction of the coating device is a result of a rotary feedthrough known per se being able to be used so as to provide compressed air for the pneumatic components of the rotary unit. The rotary feedthrough here preferably has only one compressed air channel which permits a pneumatic connection between the compressed air source of the machine frame and the rotary unit that is independent of the rotation angle. For this purpose, the rotary feedthrough can have an overall simple, robust and dimensionally compact construction. A stationary part of the rotary feedthrough is disposed on the machine frame and by way of an inlet connector fluidically connected to the compressed air source. A movable part of the rotary feedthrough is disposed on the rotary unit and, while configuring a fluid path, is connected in a sealing manner, and so as to be rotatable relative thereto, to the stationary part of the rotary feedthrough. The fluid path between the two parts of the rotary feedthrough remains independent of a rotation angle between the stationary and the movable part of the rotary feedthrough. The fluid path opens into an exhaust air connector of the movable part, said exhaust air connector being connected to the valve device.

The compressed air flow provided by way of the rotary feedthrough, by the valve device, can be distributed to a multiplicity of pneumatically controlled and/or pneumatically operated components, the latter being able to be disposed according to the requirement and in large numbers on the rotary unit. The arrangement of the valve device on the rotary unit facilitates the simple design embodiment of the rotary feedthrough. As has already been explained above, the compressed air can preferably be guided from the compressed air source to the rotary unit by way of only one compressed air channel, and by the valve device be divided among a multiplicity of compressed air lines on the exhaust air side. Said compressed air lines lead to the valves of the spray units and, by virtue of the arrangement of the valve device on the rotary unit, can be designed so as to be comparatively short. This improves the controllability of the valves.

It is within the scope of the invention that the compressed air flow between the rotary feedthrough and the valve device can be divided into a plurality of sub-flows so as to be able to supply further pneumatic components on the rotary unit with compressed air independently of the valve device. It is furthermore within the scope of the invention that further pneumatic components, in addition to the rotary feedthrough, can be disposed in the pneumatic connection between the compressed air source and the valve device.

The valve device is preferably designed as a valve island. Such a valve island can be equipped with a multiplicity of so-called valve disks in a flexible manner and according to the requirement, said valve disks potentially being adapted to the type and number of pneumatic components of the rotary unit to be driven and/or to be controlled. To this end, the valve island usually has a distributor rail having a central intake air connector. The distributor rail moreover has a multiplicity of distributor connectors by way of which the valve disks are supplied with compressed air. As a result, the compressed air for the valves to be controlled can be provided in a compact manner in terms of construction.

In one advantageously refinement, the pump for the coating agent is designed so as to be compressed air operated and is connected to the compressed air source at least by way of the rotary feedthrough.

According to the refinement described above, the compressed air is used for controlling the delivery of coating agent as well as for driving the pump. In this way, it is an advantage that the use of different types of power and signal transmission can be dispensed with, and compressed air is used for controlling as well as used as an energy carrier.

It is within the scope of the advantageous refinement that the compressed air operated pump is connected to the rotary feedthrough by way of the pneumatic valve device and herein is preferably controllable by the valve device. Preferably however, the pump is operated independently of the pneumatic valve device and connected to the rotary feedthrough by way of a pneumatic branching member which can be designed as a T-piece or a Y-piece, for example. The pneumatic branching member can in a simple manner be disposed in a compressed air line between the rotary feedthrough and the valve device. As a result, a compressed air flow can be guided to the rotary unit by way of the rotary feedthrough, and by the pneumatic branching member be divided between the valve device and the pump. This has inter alia the advantage that the compressed air flow required for the pump is not delimited by the valve device. Furthermore, the valve device can be of the compact design because the air-conducting regions of said valve device, and the cross sections thereof, do not have to be sized as a function of a compressed air flow required for the operation of the pump.

In one advantageous refinement, the machine frame comprises an electric control unit, and the pneumatic valve device is designed so as to be electrically controllable. Furthermore, the rotary feedthrough here has at least one signal line. The control unit and at least the valve device for transmitting signals are connected to one another by this signal line of the rotary feedthrough.

According to the refinement described above, the rotary feedthrough is not only fluid-conducting but also configured for transmitting signals. A design embodiment of this type does not conflict with a simple construction of the rotary feedthrough which is simple according to the invention. Rather, the signal line for transmitting electric signals can be configured in a simple manner in the form of an electrical sliding contact between the stationary and the moving part of the rotary feedthrough. It is within the scope of the advantageous refinement that the signal line has multiple poles and a plurality of sliding contacts are correspondingly configured in the rotary feedthrough. It is furthermore within the scope of the advantageous refinement that the signal line is designed as an optical signal line for transmitting optical signals. To this end, the mutually rotatable parts of the rotary feedthrough for transmitting signals are connected to one another by way of optical coupling elements. The electric control unit as well as the valve device preferably have in each case at least one optoelectronic element by which electric signals can be converted into optical signals and vice versa.

The control unit can be configured as a control computer or as a programmable logic controller, either being in each case operated in isolation or conjointly with other control units in a control network. A control program which represents the control logic by way of which at least the valve device and thus the valves of the spray units can be controlled is preferably implemented in the control unit. Should the compressed air supply of the pump take place by way of the valve device, the pump can preferably also be controlled by way of the valve device.

In a simple embodiment, the control unit serves for emitting control signals in the form of control voltages, preferably in the range from 0 to 24 Volts. By way of the control line of the rotary feedthrough, these voltages can be provided directly at the valves of the valve device in order for said valves to be actuated. Upon a drop in the voltage, said valves can be moved to a non-activated initial position by a spring return, for example. Besides the electric control signals, no electric power supply is thus required in principle for the operation of the valve device.

The valve device can have at least one analog and/or digital signal input. This signal input serves for receiving control signals of the control unit, by which signals the compressed air distribution on the rotary unit is controllable. A plurality of signal inputs can be physically combined and be designed as a multipole connector, the poles of the latter being in each case connected to one valve of the valve device so as to directly actuate the latter. This is conceivable in particular when the valve device is designed as a valve island.

The coating device preferably has a workpiece detection unit or sensor which is designed for detecting the presence, as well as preferably also the dimensions, of the workpiece to be coated, and as a function thereof for emitting a control signal to the control unit. The control unit evaluates the control signal and emits one or a plurality of opening signals to the valve device, so as to preferably open only the valves of those spray units that are situated above the workpiece. In this way, coating agent can be delivered only in the region of the workpiece to be coated and thus with high efficiency.

It is likewise within the scope of the advantageous refinement that a rotation angle sensor is configured for detecting the rotational position of the rotary unit in relation to the machine frame and for emitting a measured rotation angle to the control unit. The positions at which the spray units are situated on the rotary unit are preferably stored in the memory of the control unit. In this way, it can be determined as a function of the detected rotation angle which of the spray units is situated in the region above a workpiece to be coated. It is not mandatory here for the coating device to have a workpiece detection unit by which the presence or the dimensions of the workpiece to be coated are detected. Instead, the delivery of coating agent can always take place when one or a plurality of the spray units sweep across a defined region of the workpiece receptacle. In this way, a delivery of coating agent can take place independently of whether or not a workpiece to be coated is situated in this swept region. An arrangement of this type is particularly advantageous when the workpieces to be coated are fed into the coating device in large numbers and at minor mutual spacings.

It is within the scope of the advantageous refinement that at least one other component which is situated on the rotary unit is also controlled by way of the control line of the rotary feedthrough. The rotary feedthrough by way of the control line can in a simple manner emit the corresponding control signals to the valve device, the latter in turn relaying the signals to the other components to be controlled. However, it is also within the scope of the advantageous refinement that the valve device does not lie in the signal path between the rotary feedthrough and the other components to be controlled. A communications bus can be provided in a simple manner so that the signal path between the rotary feedthrough and the valve device can be subdivided so as to be able to control the other components to be controlled with little complexity in terms of wiring and preferably only one signal line of the rotary feedthrough.

In one advantageous refinement the rotary feedthrough is designed for transmitting electric power. The machine frame here furthermore comprises an electric voltage source which, by way of the rotary feedthrough, for transmitting power is connected at least to the valve device.

The valve device is preferably equipped with components which require a permanent voltage supply, for example a microcontroller or any other data processing unit. Moreover, it is possible for at least one analog-digital converter or a sensor to be provided on the valve device. Moreover, the valve device can be designed in such a manner that communication with the control unit can take place by standardized protocols such as TCP-IP and in real time. In order for an electric power to be able to be provided by the electric voltage source for the valve device as well as preferably other components of the rotary unit, the rotary feedthrough, besides the signal line, preferably has an electric current line for transmitting electric power. The electric current line is preferably designed as a two-pole sliding contact. The current line is connected to the electric voltage source, on the one hand, and to the valve device, on the other hand. Additionally or alternatively, a wireless transmission of power by the rotary feedthrough is also conceivable. Instead of being transmitted along a current line and by electric contacts, the electric power here can be transmitted by electromagnetic fields which are not wire-bound, in particular by inductive and/or capacitive coupling.

In another advantageous refinement, at least the electric controllable valve device and the control unit for transmitting signals are connected to one another by a wireless transceiver assembly.

As a result of the refinement described above, the transmission of control signals from the control unit to the valve device can take place wirelessly and independently of the rotary feedthrough. The transceiver assembly here comprises at least one first communications element which is connected to the control unit, as well as a second communications element which is connected to the valve device, wherein the two communications elements serve for wirelessly transmitting control signals. The second communications element for transmitting signals can preferably also be connected to another electrically controllable component on the rotary unit.

It is within the scope of the advantageous refinement that the first communications element is a wireless transmitter and the second communications element is a wireless receiver so as to be able to transmit control signals wirelessly from the control unit to the valve device. Alternatively, the first and the second communications element can in each case be designed as WiFi or WLAN modules, the communication of signals thereof taking place by way of a common network in which said modules are operated. The first communications element for the purpose of power supply can be connected to the voltage source on the machine frame. The second communications element disposed on the rotary unit can have a dedicated energy storage, for example in the form of a rechargeable electric battery.

In one advantageous refinement, a pneumatically operated electric generator is disposed on the rotary unit, said generator being connected to the compressed air source at least by way of the rotary feedthrough and being designed to supply at least the valve device with electric power.

According to the refinement described above, the rotary feedthrough serves for providing a compressed air flow for the compressed air operated generator. The latter converts this compressed air flow into electric power. As a result, it is possible to configure the rotary feedthrough without the potential for transmitting electric power, and to preferably operate the electrically operated components of the rotary unit independently of a stationary voltage source on the machine frame. In order to guarantee an uninterrupted electric power supply on the rotary unit, a rechargeable electric battery can serve as an electric intermediate storage. The rechargeable battery can preferably be charged by the generator. If required, other components on the rotary unit that require an electric power supply can also be supplied with electric power by the generator and/or the rechargeable battery.

In one advantageous refinement, the pump on the intake air side is connected to the rotary feedthrough at least by way of a pump pressure regulator. The pump pressure regulator is preferably designed so as to be electrically controllable.

The pump pressure regulator serves for regulating a possibly variable input pressure of the compressed air provided by the rotary feedthrough to a constant and usually lower output pressure. The pump pressure regulator preferably comprises a so-called pressure booster for regulating the input pressure to a higher output pressure.

Since the delivery of coating agent from the spray units is a direct function of the pump pressure, the quality of the coating result can also be optimized by a drive pressure of the pump that is regulated in such a manner.

The pump pressure regulator can be designed in a simple manner as a mechanical component, wherein the output pressure to be regulated can be adjusted manually, in a manner known per se, and directly at the pump pressure regulator. The pump pressure regulator is preferably designed as an electrically controllable component. The control unit here is configured for emitting a control signal for regulating the output pressure. Should the rotary feedthrough have a signal line, the control signal can be emitted from the control unit to the pump pressure regulator by way of the rotary feedthrough. The valve device here can lie in the signal path between the pump pressure regulator and the rotary feedthrough. Should the coating device have a wireless transceiver assembly, the latter can be utilized for transmitting the control signal from the control unit to the pump pressure regulator. It is likewise within the scope of the advantageous refinement that the pump pressure regulator is pneumatically controllable and is preferably controlled by way of the valve device.

The control unit is preferably connected to an input element, for example a tablet, that is easy to operate, or connected to the operating panel of the coating device. As a result, the output pressure to be regulated can be specified in a simple manner.

Should the pump, in order to be supplied with compressed air, be connected to the rotary feedthrough by way of the valve device, the pump pressure regulator can advantageously be integrated in the valve device on the exhaust air side. In this case, the control signal of the control unit can be provided to the valve device, the latter emitting the control signal directly or in a processed form to the pump pressure regulator. The valve device can in particular comprise an analog-digital converter for converting the control signal for the pump pressure regulator.

Should the pump be connected to the rotary feedthrough by way of the pneumatic branching member in order to be able to be operated independently of the valve device, the pump pressure regulator is preferably disposed between said branching member and the pump. In this arrangement, the pump pressure regulator preferably also serves for controlling the operation of the pump. For this purpose, an output pressure to be adjusted can be transmitted to the pump pressure regulator by way of a corresponding control signal when required. For example, the specified output pressure is 0 bar when the operation of the pump is to be terminated. Accordingly, the output pressure to be adjusted can correspond to 4 bar, for example, in order for the operation of the pump to be started. In this embodiment, the compressed air supply of the pump and of the pump pressure regulator is indeed independent of the valve device. Nevertheless, the valve device can lie in the signal path between the control device and the pump pressure regulator and also emit signals to electrically controllable components of the rotary unit, the latter not being pneumatically connected to the valve device.

It is furthermore within the scope of the advantageous refinement that the pump pressure regulator can comprise a measurement member which is utilized for measuring the adjusted pump pressure and to emit the latter to the control unit. As a result, the operation of the pump can be monitored during the coating process.

A potentially required electric voltage for operating the electrically controllable pump pressure regulator can be provided in a simple manner by way of the rotary feedthrough, or by way of the compressed air operated generator on the rotary unit. The valve device can preferably also be utilized for providing electric power for the pump pressure regulator or other electric components which are situated on the rotary unit.

In one advantageous refinement, a coating agent pressure regulator is disposed between the pump and at least one of the spray units, wherein the coating agent pressure regulator is preferably designed so as to be electrically controllable.

The coating agent pressure regulator serves for regulating the pressure of the coating agent in relation to the conveying pressure of the pump so as to achieve an adjustable output pressure and for reducing the prevailing conveying pressure, or to increase said prevailing conveying pressure by a pressure booster, if required in the process. The coating agent pressure regulator can be designed in a simple manner as a mechanical component in which the output pressure is manually adjustable. Alternatively, the coating agent pressure regulator can be pneumatically controllable. When the coating agent pressure regulator is designed so as to be electrically controllable, control signals from the control unit can be emitted to the coating agent pressure regulator by way of the signal line of the rotary feedthrough, or by way of the wireless transceiver assembly. It is within the scope of the advantageous refinement that the valve device lies in the signal path between the control unit and the coating agent pressure regulator. A potentially required electric voltage for operating the electrically controllable coating agent pressure regulator can be provided in a manner analogous to the embodiments in the context of the pump pressure regulator by way of the rotary feedthrough or by way of the compressed air operated generator.

In one advantageous refinement, the spray units each have a compressed air operated atomizer unit for atomizing the coating agent, the atomizer unit being connected to the compressed air source at least by way of the rotary feedthrough.

The atomizer unit, by means of compressed air, serves for converting the delivered coating agent into a multiplicity of finely distributed droplets. As a result, the coating agent can be distributed homogenously on the workpiece surface, and the coating quality can be optimized. For this purpose, the atomizer unit can be operatively connected to the spray unit in various ways. It lies within the scope of the advantageous refinement here that the atomizer unit has at least one compressed air outlet which in terms of the flow direction of the coating agent is disposed behind a coating agent delivery opening of the spray unit. The compressed air outlet here is preferably configured as an annular gap. Additionally or alternatively, the compressed air outlet can be configured as one or a plurality of bores which are situated laterally behind the coating agent delivery opening of the spray unit. It is furthermore within the scope of the advantageous refinement that the atomizer unit and the spray unit are combined in terms of construction and are disposed in a common housing, or in terms of construction are configured so as to be mutually separate.

It is within the scope of the advantageous refinement that the atomizer unit is pneumatically connected to the rotary feedthrough by way of the valve device. The operation of the atomizer unit here can be controlled by the valve device. Alternatively, the atomizer unit is connected to the rotary feedthrough by way of the pneumatic branching member already described above, or by way of another branching member, and is operated independently of the pneumatic valve device. For this purpose, the pneumatic branching member can be designed in the manner already described as a T-piece, or as a comparable pneumatic construction element, for dividing the compressed air flow at least between the valve device and the atomizer unit, said compressed air flow for the rotary unit being provided by the rotary feedthrough.

In one advantageous refinement, an atomizer pressure regulator is disposed between at least one of the atomizer units and the rotary feedthrough. The atomizer pressure regulator is preferably designed so as to be electrically controllable.

In a manner analogous to the embodiments in the context of the pump pressure regulator, it is possible by the atomizer pressure regulator to regulate prevailing input pressure on the atomizer pressure regulator so as to achieve an adjustable output pressure. The input pressure here can preferably be reduced, or increased by a pressure booster. Experiments of the applicant have demonstrated that an output pressure between 2 and 4 bar is preferably to be adjusted for the atomizer pressure regulator in order to achieve an optimum coating result.

The atomizer pressure regulator is preferably connected to a plurality of atomizer units, preferably to all atomizer units, of the rotary unit. It is advantageous here that only one atomizer pressure regulator is required for regulating the atomizer pressures of a plurality of atomizer units. When the atomizer pressure regulator is connected to a plurality of atomizer units, an assembly of a plurality of pneumatic branching members can be disposed between the atomizer pressure regulator and the atomizer units. As a result, the compressed air flow delivered by the atomizer pressure regulator can be subdivided among the plurality of atomizer units, preferably among all atomizer units. It is within the scope of the advantageous refinement that the atomizer pressure regulator is mechanically or pneumatically controllable.

The atomizer pressure regulator is preferably designed so as to be electrically controllable. The control unit here for transmitting signals is connected to the atomizer pressure regulator by way of the signal line of the rotary feedthrough, or by the wireless transceiver assembly. The required output pressure for an optimum coating result here can be adjusted by a control signal of the control unit. It is also within the scope of the advantageous refinement that the atomizer pressure regulator can comprise a sensor for measuring and monitoring the atomizer pressure, and during the operation of the coating device transmits the output pressure to the control unit. It is within the scope of the advantageous refinement that the valve device is situated in the signal path between the rotary feedthrough and the atomizer pressure regulator.

The potentially required electric power for operating the electrically controllable atomizer pressure regulator can be provided in a simple manner by way of the rotary feedthrough. The provision of the electric power for the atomizer pressure regulator can preferably also take place by way of the valve device when the latter for transmitting power is connected to the rotary feedthrough. Alternatively, the potentially required electric power can be provided by way of the compressed air operated generator.

In one advantageous refinement, at least one of the spray units has at least one compressed air operated forming-air unit for adjusting a jet shape of the coating agent delivered from the spray unit, the forming-air unit being connected to the compressed air source at least by way of the rotary feedthrough.

The jet shape of the coating agent delivered from the spray unit represents an important factor influencing the achievable coating quality. The forming-air unit serves for influencing said jet shape of the coating agent. For this purpose, the forming-air unit has a mechanically adjustable air flap on which one or a plurality of air nozzles are situated. The compressed air management can be changed according to requirements by mechanically adjusting the air flap, so as to as a function adjust the jet shape of the coating agent.

It is within the scope of the advantageous refinement that the rotary feedthrough is pneumatically connected to the forming-air unit by way of the valve device. Alternatively, the forming-air air unit is preferably connected to the rotary feedthrough by way of the pneumatic branching member already described above, or another pneumatic branching member. The forming-air unit here is provided with compressed air independently of the pneumatic valve device. The pneumatic branching member, in a manner already explained, can comprise a T-piece or a comparable pneumatic construction element, for dividing the compressed air flow at least among the valve device and the forming-air unit, said compressed air flow for the rotary unit being provided by the rotary feedthrough.

In one advantageous refinement, a forming-air pressure regulator which is preferably designed so as to be electrically controllable is disposed between the forming-air unit and the rotary feedthrough.

The forming-air pressure, by means of the forming-air pressure regulator, can be regulated from an elevated input pressure to an adjustable output pressure and be reduced or increased when required. The pressure level of the forming-air pressure here is preferably between 2 and 4 bar so that the output pressure of the forming-air pressure regulator can be correspondingly adjusted in order to achieve an optimum coating result. In a manner analogous to the embodiments in the context of the pressure regulators already described, the output pressure of the forming-air pressure regulator here can be manually or pneumatically controlled.

The forming-air pressure regulator is preferably designed so as to be electrically controllable. The control unit for transmitting signals here is connected to the forming-air pressure regulator by way of the signal line of the rotary feedthrough, or by the wireless transceiver unit. As a result, the required output pressure for an optimum coating result can be adjusted by a control signal of the control unit. It is within the scope of the advantageous refinement that the forming-air pressure regulator can have a sensor for measuring and monitoring the forming-air pressure and transmits the output pressure to the control unit during the operation of the coating device. It is within the scope of the advantageous refinement that the valve device is situated in the signal path between the rotary feedthrough and the forming-air pressure regulator.

Depending on whether the forming-air unit is connected to the rotary feedthrough by way of the valve device or by way of the branching member, the forming-air pressure regulator can be disposed between the forming-air unit and the valve device, or between the forming-air unit and the branching member. The forming-air pressure regulator is preferably connected to a plurality of forming-air units, preferably to all forming-air units, on the rotary unit. It is advantageous here that only one forming-air pressure regulator is required for regulating the forming-air pressures of a plurality of forming-air units.

The potentially required electric power for operating the electrically controllable forming-air pressure regulator can be provided in a simple manner by way of the rotary feedthrough. The provision of electric power for the forming-air pressure regulator can preferably also take place by way of the valve device when the latter for transmitting power is connected to the rotary feedthrough. Alternatively, the potentially required electric power can be provided by way of the compressed air operated generator.

In one advantageous refinement, the rotary unit comprises a plurality of actuators on each of which is disposed at least one of the spray units. The actuators are designed for adjusting a status, preferably an orientation, of the at least one respective spray unit disposed thereon in relation to the workpiece receptacle.

According to the refinement described above, the actuators serve for adjusting the status, and preferably the orientation, of the spray units in relation to the workpiece in such a manner that the latter can be uniformly coated. This is advantageous because the statuses of the spray units, that comprise in each case a position and an orientation, in relation to the workpiece receptacle and the workpiece disposed thereon change by virtue of the rotating movement of the rotary unit. The actuator preferably serves for adjusting only the orientation, thus the relative angular position, of at least one spray unit in relation to the workpiece.

The actuators are preferably configured to be controlled as a function of a rotational position of the rotary unit in relation to the machine frame. A mechanical control is in particular conceivable here. For this purpose, the actuators, for example by a rod or any other force transmission element, can be coupled to a cam track which is disposed on the machine frame. The cam track is preferably formed by a groove or edge which encircles the rotation axis of the rotary unit. The profile of the cam track here preferably corresponds approximately to an oval or preferably a Cassini oval, the shape of the latter corresponding substantially to that of an oval depressed on two sides. In a rotating movement of the rotary unit, the rod on the end side slides along the cam track and, in a manner corresponding to the profile of the cam track, exerts forces on the actuators. These forces in turn cause an adjustment of the respective spray unit connected to the actuators.

In one advantageous refinement, the actuator comprises an electric drive and is designed so as to be electrically controllable.

The refinement described above makes it possible for the respective spray unit or plurality of spray units connected to the actuators to be electrically adjusted. The actuators are preferably in each case a servo drive by way of which the status, in particular the orientation, of the spray unit can be adjusted by controlling the path and/or the angle. The electric drive of the actuators for transmitting signals here is preferably connected to the control unit by way of the rotary feedthrough, wherein the electrically controllable valve device preferably lies in the signal path between the rotary feedthrough and the actuators. Alternatively, the actuators for transmitting signals is connected to the control unit by way of the wireless transceiver assembly. The required electric power for the electric drive can preferably be provided by way of the rotary feedthrough and preferably by way of the valve device. Alternatively, the required electric power can be provided by way of the compressed air operated generator.

The advantage of an electrically controlled adjustment of the spray unit lies in that the latter can be flexibly adapted and is not susceptible to malfunctions during operation. It is in particular possible for the orientations of the spray units to be adapted in a simple manner to workpieces of dissimilar geometries and dimensions.

In one advantageous refinement, the workpiece receptacle is designed as a conveyor belt so as to by, a linear movement, convey the workpiece from an inlet region of the machine frame to an outlet region. In each case one of the spray units in a rotating movement of the rotary unit sweeps across the workpiece in the inlet region and in the outlet region. The workpiece is preferably swept across along at least two intersecting trajectories such that a crisscross spray pattern results on the workpiece.

According to the refinement described above, the workpiece ahead of the inlet region is disposed on the conveyor belt, and by the conveyor belt is conveyed into the outlet region and beyond the latter. The conveying movement preferably takes place at an adjustable and preferably constant speed.

At least one spray unit of the rotary unit sweeps across the workpiece in the inlet region. The superimposed rotating movement of the rotary unit and the linear displacement movement of the workpiece result in a crescent-shaped path for the trajectory of the spray unit in the inlet region. The same spray unit, or one of the remaining spray units of the rotary unit, subsequently sweep across the workpiece in the outlet region. This likewise results in a crescent-shaped path which overlaps the crescent-shaped path applied in the inlet region.

The procedure described above is preferably repeated multiple times, wherein the crescent-shaped paths in the inlet region and in the outlet region are preferably applied to the workpiece so as to be mutually offset, in order for said workpiece to be coated over the entire area. The intersecting crescent-shaped paths along which the coating agent is applied to the workpiece lead to a homogenous distribution of the coating agent, this appearing particularly uniform to the human eye.

In one advantageous refinement, the rotary joint has a coating agent channel and a rinsing agent channel which are isolated from one another by at least one seal, the coating agent channel being designed for fluidically connecting the coating agent source to the pump, and the rinsing agent channel being designed for receiving a leakage flow which exits at the seal, for instance, and contains coating agent from the coating agent channel.

As already explained above, the rotary joint serves for providing a fluid-conducting connection between the coating agent source of the machine frame and the pump of the rotary unit. This fluid-conducting connection is formed by the coating agent channel which is formed partially by the stationary rotary joint part and partially by the rotatable rotary joint part. The coating agent channel between the rotary joint parts has a transition region in which the coating agent from the stationary rotary joint part makes its way into the rotatable rotary joint part. The rotary joint parts are mutually separated in this region, the mutual relative rotation of said rotary joint parts being made possible as a result. However, this separation between the rotary joint parts is associated with at least one gap or channel being formed between said rotary joint parts. Such a gap or channel is usually sealed by the seal already mentioned above, so as to prevent any uncontrolled exit of coating agent from the rotary joint. However, it cannot be permanently and completely precluded that coating agent as a leakage flow from the coating agent channel makes its way past the seal.

In order for the leakage flow in terms of the flow direction thereof not to dry between the rotary joint parts behind the seal, and potentially adhesively bond said rotary joint parts, the rinsing agent channel is configured in the rotary joint. This rinsing agent channel in terms of the flow direction of the leakage flow is disposed in such a manner that the leakage flow can make its way into the rinsing agent channel while bypassing the seal and with a rinsing agent situated in said rinsing agent channel can be rinsed away. Since there are usually lower pressures in the rinsing agent channel than in the coating agent channel, said rinsing agent channel can correspondingly be sealed more easily in relation to the environment thereof. Moreover, the sealing of the rinsing agent channel is simplified because the rinsing agent contains fewer corrosive or abrasive substances in comparison to the coating agent.

It is within the scope of the advantageous refinement that the rotary joint can have a plurality of coating agent channels by way of which a plurality of pumps are connected in each case to one coating agent source. It is furthermore within the scope of the advantageous refinement that the rotary joint can have a plurality of rinsing agent channels. The rinsing agent channels and the coating agent channels in pairs here are in each case mutually isolated by a seal, wherein a leakage flow unavoidably exiting at the seal can be rinsed away by the respective rinsing agent channel. It is also within the scope of the advantageous refinement that two coating agent channels are assigned to one common rinsing agent channel and are isolated from the latter by in each case one leakage-afflicted seal. The rinsing agent channel here serves for simultaneously rinsing away a plurality of leakage flows of dissimilar coating agents.

In one advantageous refinement, the rinsing agent channel is connected to a rinsing agent source by way of a rinsing agent inlet on the rotary joint. Furthermore, the rinsing agent channel by way of a rinsing agent outlet on the rotary joint is connected to a rinsing agent sink.

According to the refinement described above, the rinsing agent source preferably comprises a rinsing agent tank and a rinsing agent pump. The rinsing agent pump serves for conveying rinsing agent from the rinsing agent tank into the rinsing agent channel, and to allow said rinsing agent to circulate at a preferably adjustable pressure at least in the rotary joint before said rinsing agent by way of the rinsing agent outlet is drained to the rinsing agent sink. The rinsing agent sink is preferably at least in part formed by the same rinsing agent tank to which the rinsing agent pump is also connected. It is also within the scope of the advantageous refinement that a second rinsing agent tank is provided for the rinsing agent sink, contaminated rinsing agent which cannot be reused being able to be drained from the rinsing agent outlet into said second rinsing agent tank.

In one advantageous refinement, a temperature sensor is disposed on or in the rotary joint.

In the operation of coating devices, it is customary for the coating agent or, for instance, the rinsing agent, to be inflammable. An explosive mixture of coating agent and air can be created in particular when the coating agent is being sprayed. For safety reasons, it is therefore desirable to ensure that those components that in a thermally conducting manner are in contact directly or indirectly with the inflammable coating agent and/order rinsing agent and/or coating agent-air mixture are operated in a temperature range below the respective ignition temperature. Since the rotary joint serves for conducting coating agent as well as preferably rinsing agent, the operational safety of the coating device is enhanced when the temperature is measured in the region of the rotary joint, or the temperature of the rotary joint is measured. It is particularly advantageous for the temperature sensor to be disposed in the region of the coating agent channel and/or in the region of the rinsing agent channel, so as to be able to detect the temperature directly in those regions in which there is a risk of ignition. It is likewise within the scope of the advantageous refinement that the temperature sensor is disposed in the region of the seals of the rotary joint, because more heat is created in this region during the operation of the rotary joint than in the remaining structure of the rotary joint.

Besides the fire and/or explosion protection, the temperature at or in the rotary joint is also relevant because said temperature influences the viscosity of the coating agent. Measuring the temperature thus also permits an at least partial conclusion pertaining to the quality of the coated workpieces. Moreover, the quality of the coated workpieces can be positively influenced by suitably temperature-controlling the rotary joint as a function of the measured temperature.

During the operation of the coating device, the temperature sensor preferably transmits the detected temperatures to the control unit by way of the valve device and the rotary feedthrough. The temperature signal here can be present as an analog signal and be converted into a digital signal by the valve device. A field bus connection can serve for transmitting the signal converted in such a manner to the control unit by way of the rotary joint so that said signal can be utilized for controlling the coating device. It is in particular within the scope of the advantageous refinement that the pump output of a rinsing agent pump for conveying the rinsing agent in the rinsing agent channel can be adapted as a function of the temperature signal, so that the conveyed rinsing agent can also serve as a coolant. Alternatively, the transmission of the detected temperature can take place by way of the wireless transceiver assembly.

In one advantageous refinement, the rotary unit has a main body in which at least the pump and the valve device are disposed. Furthermore, the rotary unit has a plurality of support arms on each of which is/are disposed at least one of the spray units, preferably in each case two spray units. The support arms in terms of the rotation axis of the rotary unit preferably protrude in each case radially away from the main body.

The main body can be formed from a frame which imparts stability and stiffness to the rotary unit. Additionally, the main body can have one or a plurality of planar cladding elements by way of which the interior of the main body is closed so as to be visually obscured and tight in relation to contamination. The rotation axis of the rotary unit preferably runs through the main body, wherein heavy components of the rotary unit are in particular disposed in the main body.

The support arm is preferably configured in the lightweight construction mode, for example as a hollow profile or by way of a framework structure. As an overall result, the highest proportion of weight of the rotary unit can be concentrated in the region of the rotation axis of the rotary unit. This has a favorable influence on the dimensions of the drives which are required for generating the rotating movement. The reason for this is that, as a result of the weight concentration described above, lower drive outputs are required for accelerating the rotary unit in comparison to a uniform weight distribution on the rotary unit. Furthermore, the main body can serve for receiving bearings for the movable mounting of the rotary unit in relation to the machine frame. The mounting of the rotary unit in relation to the machine frame is advantageously designed in such a manner that the rotary unit is height adjustable. This is advantageous because the height of the spray units can also be adjusted as a result, so that workpieces of dissimilar thicknesses in particular can be coated from a uniform distance.

In one advantageous refinement, the rotary joint and the rotary feedthrough are disposed so as to be mutually coaxial along the rotation axis of the rotary unit, the rotary feedthrough being situated above the rotary joint.

As a result of the rotary joint being disposed below the rotary feedthrough, the coating agent has to be conveyed only to a minimum required level in the lower region of the rotary unit, in order for said coating agent to be able to be provided for the pump disposed on said rotary unit.

In one advantageous refinement, the coating agent source comprises a low-pressure pump and a coating agent tank, the low-pressure pump being fluidically disposed between the rotary joint and the coating agent tank.

The refinement described above is based on the concept that the reliability of the supply of coating agent during operation can be enhanced when a low-pressure pump is provided additionally to the pump of the rotary unit. By being correspondingly sized, the pump of the rotary unit can indeed also be suitable on its own for suction of the coating agent through the rotary joint. However, experiments have demonstrated that the pump of the rotary device can be of significantly smaller dimensions when the low-pressure pump is additionally provided. The smaller dimensions of the pump which is disposed on the rotary unit are associated with a correspondingly smaller required installation space and weight for the rotary unit. When required, a pressure difference between the coating agent channel and the rinsing agent channel rotary joint can be adjusted by the additional low-pressure pump, so as to generate a pressure differential between the coating agent channel and the rinsing agent channel. The rinsing agent pump here can be adjusted to a pressure of 1.5 bar, and the low-pressure pump can be adjusted to a pressure of 2.0 bar, for example. The rinsing agent pump and the low-pressure pump are preferably double diaphragm pumps of identical construction.

BRIEF DESCRIPTION OF THE DRAWINGS

Further preferred features and embodiments of the coating device according to the invention will be explained hereunder by two exemplary embodiments and the drawings. The exemplary embodiments are merely advantageous design embodiments of the invention and thus do not limit the latter.

In the drawings.

DETAILED DESCRIPTION

Figure 1:
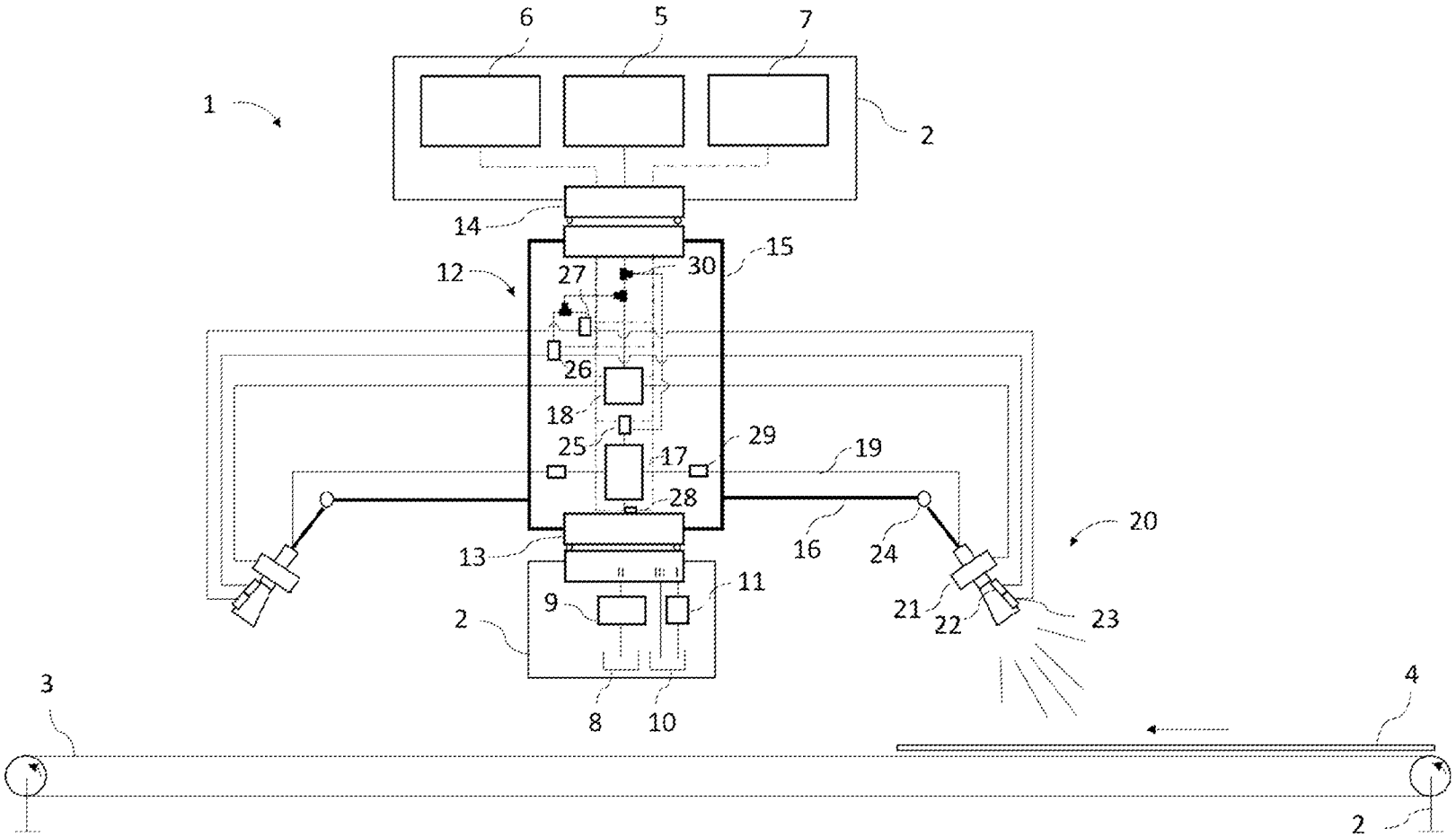
FIG. 1 shows a first exemplary embodiment of a coating device designed according to the invention, in a schematic illustration.

The coating device 1 shown in FIG. 1 comprises a machine frame 2 having a workpiece receptacle 3 on which a workpiece 4 to be coated is disposed. The workpiece 4 in the example shown is a planar timber part which is to be uniformly varnished on the surface and on the lateral edges.

Furthermore disposed in the machine frame 2 are a compressed air source 5, an electric control unit 6 as well as an electric voltage source 7. The compressed air lines emanating from the compressed air source 5, and the branches of said compressed air lines are illustrated as solid connecting lines in the illustration shown. The electric control lines emanating from the control unit 6 are illustrated as simple dashed connecting lines. The current lines emanating from the electric voltage source 7 are illustrated as chain-dotted connecting lines.

Disposed on the machine frame 2 are also a coating agent tank 8, a low-pressure pump 9, a rinsing agent tank 10 and a rinsing agent pump 11.

The coating device 1 furthermore comprises a rotary unit 12 which is rotatable in relation to the machine frame 2 and by way of a rotary joint 13 as well as a rotary feedthrough 14 is connected to the components of the stationary machine frame 2. This will be discussed in detail further below.

The rotary unit 12 comprises a main body 15 as well as a plurality of support arms which protrude from the main body 15 and of which only one support arm is provided with the reference sign 16.

The main body 15 comprises a frame, not illustrated here, which configures an interior in which a compressed air operated high-pressure pump 17 as well as a valve device 18 are disposed. The high-pressure pump 17 is designed as a double diaphragm pump. In other embodiments, the high-pressure pump 17 can also be designed as a piston pump. The valve device 18 is designed as an electrically controllable valve island.

One spray unit 20, which comprises in each case a compressed air controlled valve 21 for controlling the coating agent delivery, is disposed on each of the support arms 16. Furthermore, the spray units 20 comprise in each case one atomizer unit 22 as well as one forming-air unit 23.

Furthermore, disposed on each of the support arms 16 is an actuators (or actuator) 24 which in a manner not shown here is mechanically coupled to a cam track and by which the pivoted status of a respective spray unit 20 in relation to the workpiece receptacle 3 and the workpiece 4 situated on the latter can be adjusted.

In the manner not shown here, the coating device 1 comprises a drive by way of which the rotary unit 12 can be set in a rotating motion in relation to the machine frame 2, in particular in relation to the workpiece receptacle 3 and the workpiece 4 situated on the latter. In the process, coating agent from the spray units 20 is delivered across the surface of the workpiece 4.

The rotary joint 13 presently serves toward being able to supply the rotary unit 12 rotatable in relation to the machine frame 2, and the spray units 20 disposed on the rotary unit 12, with coating agent. For this purpose, the coating agent by the low-pressure pump 9 is conveyed into the rotary joint 13 by way of the connector II, said coating agent hereby making its way into a coating agent channel (not shown) of the rotary joint 13. The rotary joint 13 in the example shown comprises two parts which are connected to one another in a sealing manner and which are rotatable relative to one another. One stationary part of the rotary joint here is connected to the machine frame 2, and the other movable part is connected to the rotary unit 12.

This construction of the rotary joint 13 leads to an unavoidable leakage flow between the stationary part and the movable part of the rotary joint 13. While a seal is situated in this region, it can however not be permanently and completely precluded that coating agent as a leakage flow makes its way from the coating agent channel so as to bypass the seal. In order for the leakage flow in terms of the flow direction thereof not to dry between the rotary joint parts behind the seal and to potentially adhesively bond said rotary joint parts, a rinsing agent channel is configured in the rotary joint. This rinsing agent channel in terms of the flow direction of the leakage flow is disposed in such a manner that the leakage flow can make its way past the seal into the rinsing agent channel and can be rinsed away by a rinsing agent which is temporarily or permanently conveyed in said rinsing agent channel.

The rinsing agent channel extends from the connector I to the connector III of the rotary joint 13. The connector I is connected to the rinsing agent tank 10 by way of the rinsing agent pump 11, and serves for feeding the rinsing agent into the rotary joint 13. The connector III represents a drain opening by way of which the rinsing agent mixed with the removed leakage flow makes its way back into the rinsing agent tank 10 again.

The coating agent channel on the outlet side is connected to the suction side of the high-pressure pump 17. The coating agent by way of the high-pressure pump 17 makes its way to the spray units 20 via distributor lines 19.

The high-pressure pump 17 is operated by compressed air and moves conjointly with the rotary unit 12. In order to enable a simple supply of compressed air to the high-pressure pump 17, the rotary feedthrough 14 serves for providing compressed air from the compressed air source 5 for the rotary unit 12 which is rotatable in relation to the machine frame 2.

It is a peculiarity of the coating device 1 shown that the valve device 18 is disposed on the main body 15 of the rotary unit 12 and is designed for distributing in a controllable manner the compressed air provided by the rotary feedthrough 14 to the rotary unit. For this purpose, the valve device 18 is designed as a valve island and has a distributor rail on which a plurality of pneumatic valves in the form of valve disks (not shown) are disposed. The valve disks are in each case selectively able to be blocked and unblocked by an electric control signal. The required control signal is provided by the control unit 6 and by way of a signal line of the rotary feedthrough 14 likewise emitted to the valve device 18. Moreover, the rotary feedthrough 14 has a current line for transmitting power, by which the valve device 18 is also supplied with electric power from the voltage source 7. The valve device 18 on the exhaust air side by way of a multiplicity of exhaust air connectors is connected to the valves 21.

The valve device 18 in the exemplary embodiment shown here serves for controlling the valves 21. For this purpose, the valve device 18 can have comparatively minor flow cross sections and be of a compact construction as a result. In contrast, the high-pressure pump 17 for the operation thereof requires a volumetric flow which cannot be provided by the valve device 18. Instead, the high-pressure pump 17 by way of a pneumatic branching member 30 is connected to the rotary feedthrough 14. In the exemplary embodiment shown, the coating device comprises a total of three branching members which are embodied as T-pieces and serve for subdividing on the rotary unit 12 a compressed air flow, which is provided by the rotary feedthrough 14, independently of the valve device 18.

As is shown in FIG. 1, the compressed air flow by the branching member 30 is directed to the high-pressure pump 17 by way of a pump pressure regulator 25. The pump pressure regulator 25 serves for regulating the drive pressure of the high-pressure pump 17 to a desirable pressure level. In an analogous manner, one pressure regulator 26 or 27, respectively, is in each case disposed between the rotary feedthrough 14 and the atomizer units 22, as well as between the rotary feedthrough 14 and the forming-air units 23. The pressure levels here are in each case digitally adjustable by the control unit 6. The pressure regulators 25, 26, 27 for transmitting power are connected to the electric voltage source 7 by way of a current-conducting connection in the rotary feedthrough 14. A coating agent pressure regulator 29 is disposed in an analogous manner between the high-pressure pump 17 and a respective spray unit 20. The connection of the coating agent pressure regulator 29 for transmitting power and signals is not illustrated for the sake of improved clarity.

A temperature sensor 28 for monitoring the temperature of the rotary joint 13 is disposed in the region of the coating agent channel of the rotary joint 13, said temperature sensor 28 for transmitting power and signals being connected to the electric voltage source 7, or to the control unit 6, respectively, by way of the valve device 18 and the rotary joint 14. Alternatively, the temperature sensor 28 can be designed as a temperature-dependent resistor.

Figure 2:
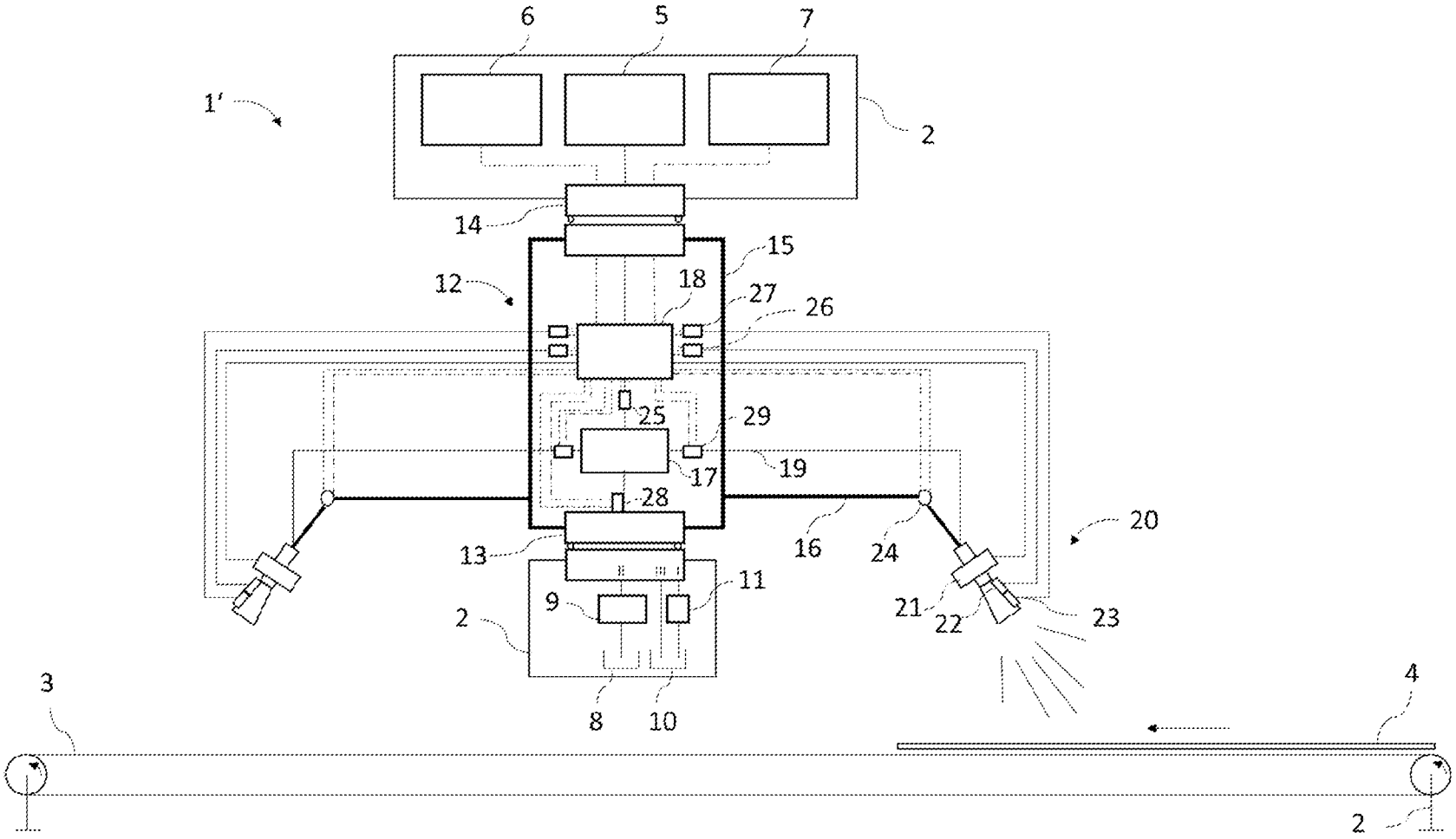
FIG. 2 shows a second exemplary embodiment of a coating device designed according to the invention, in a schematic illustration.

The coating device 1' shown in FIG. 2 in terms of the construction thereof corresponds substantially to the coating device 1 according to FIG. 1. As opposed to the coating device 1 shown in FIG. 1, the coating agent device 1' has a valve device 18 which on the rotary unit 12 serves as a central distributor element four compressed air, signals and electric power.

To this end, the rotary feedthrough 14 is constructed in a manner corresponding to the embodiments pertaining to FIG. 1, and in terms of pneumatics, signals and power is connected to the valve device 18.

A compressed air flow guided to the rotary unit 12 makes its way into the valve device 18 and, as a function of the control signals of the control unit 6, can be divided among the pneumatically controlled and/or driven components on the rotary unit 12. Furthermore, the valve device 18 is designed to emit control signals of the control unit 6 directly or in a modified form to other electrically controlled components. In the exemplary embodiment shown, the valve device 18 emits electric control signals to the pressure regulators 25, 26, 27 and 29.

Moreover, the valve device 18 by way of suitable signal inputs is designed to receive the temperatures measured by the temperature sensor 28 and to emit said temperatures to the control unit 6. The coating device 1' furthermore has electrically controllable actuators (or an electrically controllable actuator) 24 which for transmitting signals are connected to the valve device 18.

The valve device 18 furthermore has electrical connectors for providing electric power to the electrically operated components on the rotary unit 12. For this purpose, the valve device for transmitting power is connected to the pressure regulators 25, 26, 27, 29, to the temperature sensor 28 as well as to the electrically controllable actuators 24.

A further difference between the coating device 1' according to FIG. 2 and the coating device 1 according to FIG. 1 lies in that the coating device 1' for the atomizer units 22 has in each case one pressure regulator 26 and for the forming-air units 23 has in each case one pressure regulator 27.

The invention claimed is:

1. A coating device for applying a coating agent to the surface of a workpiece, the coating device comprising:

a machine frame having a workpiece receptacle, a coating agent source and a compressed air source, a rotary unit which is rotatable in relation to the machine frame and has at least one pump and a plurality of spray units, the at least one pump on a suction side being connected to the coating agent source by a fluid-conducting rotary joint, and on a pressure side being connected to the plurality of spray units, and the rotary unit has a pneumatic valve device, and the plurality of spray units each have a compressed air controlled valve for controlling the delivery of coating agent, the pneumatic valve device on an intake air side is connected to the compressed air source at least by way of a fluid-conducting rotary feedthrough, and on an exhaust air side is connected to the compressed air controlled valves of the plurality of spray units.

2. The coating device as claimed in claim 1, wherein the at least one pump is configured to be operated by compressed air, and is connected to the compressed air source at least by way of the rotary feedthrough.

3. The coating device as claimed in claim 1, wherein the pneumatic valve device is electrically controllable, the rotary feedthrough has at least one signal line, and the machine frame comprises an electric control unit which for transmitting signals is connected at least to the valve device by the rotary feedthrough.

4. The coating device as claimed in claim 1, wherein the rotary feedthrough is configured for transmitting electric power, and the machine frame comprises an electric voltage source which for transmitting power is connected at least to the valve device by the rotary feedthrough.

5. The coating device as claimed in claim 1, wherein the pneumatic valve device is electrically controllable, and the machine frame comprises an electric control unit, and at least the valve device and the control unit are connected by a wireless transceiver for signal transmission.

6. The coating device as claimed in claim 5, further comprising a pneumatically operated generator disposed on the rotary unit, said pneumatically operated generator at least being connected to the compressed air source by way of the rotary feedthrough and being configured to supply at least the valve device with electric power.

7. The coating device as claimed in claim 2, wherein the at least one pump on the suction side is connected to the rotary feedthrough by a pump pressure regulator, and the pump pressure regulator is electrically controllable.

8. The coating device as claimed in claim 1, wherein a coating agent pressure regulator is disposed between the at least one pump and at least one of the spray units, and the coating agent pressure regulator is electrically controllable.

9. The coating device as claimed in claim 1, wherein at least one of the spray units has at least one compressed air operated atomizer unit to atomize the coating agent, and the atomizer unit is connected to the compressed air source at least by way of the rotary feedthrough.

10. The coating device as claimed in claim 9, further comprising an atomizer pressure regulator which is electrically controllable is disposed between the atomizer unit and the rotary feedthrough.

11. The coating device as claimed in claim 1, wherein at least one of the spray units has at least one compressed air operated forming-air air unit that adjusts a jet shape of the coating agent delivered from the spray unit, and the forming-air air unit is connected to the compressed air source at least by way of the rotary feedthrough.

12. The coating device as claimed in claim 11, further comprising a forming-air pressure regulator which is electrically controllable is disposed between the forming-air air unit and the rotary feedthrough.

13. The coating device as claimed in claim 1, wherein the rotary unit comprises a plurality of actuators on each of which is disposed one of the spray units, the actuators being configured to adjust a status of the respective spray unit disposed thereon in relation to the workpiece receptacle.

14. The coating device as claimed in claim 13, wherein the actuators comprise in each case at least one electric drive and are electrically controllable.

15. The coating device as claimed in claim 1, wherein the workpiece receptacle comprises a conveyor belt that is configured to convey a workpiece via a linear movement from an inlet region of the machine frame to an outlet region, and the plurality of spray units are configured to move in a rotating movement via the rotary unit in a sweeping across the workpiece conveyed by the conveyor belt in the inlet region and in the outlet region.

16. The coating device as claimed in claim 1, wherein the rotary joint has a coating agent channel and a rinsing agent channel which are isolated from one another by at least one seal, the coating agent channel being configured to fluidically connect the coating agent source to the at least one pump, and the rinsing agent channel being configured to receive a leakage flow which exits at the seal and contains coating agent from the coating agent channel.

17. The coating device as claimed in claim 16, wherein the rinsing agent channel is connected to a rinsing agent source by a rinsing agent infeed on the rotary joint, and the rinsing agent channel is connected to a rinsing agent sink by a rinsing agent outlet on the rotary joint.

18. The coating device as claimed in claim 1, further comprising at least one temperature sensor disposed in or on the rotary joint.

19. The coating device as claimed in claim 1, wherein the rotary unit has a main body in which at least the at least one pump and the valve device are disposed, and the rotary unit includes a plurality of support arms on each of which is disposed at least one of the spray units.

20. The coating device as claimed in claim 1, wherein the rotary joint and the rotary feedthrough are disposed so as to be mutually coaxial along a rotation axis of the rotary unit, and the rotary feedthrough is situated above the rotary joint.

21. The coating device as claimed in claim 1, wherein the coating agent source comprises a low-pressure pump and a coating agent tank, and the low-pressure pump is fluidically disposed between the rotary joint and the coating agent tank.

* * * * *